United States Patent [19]

Felter

[11] 4,318,338

[45] Mar. 9, 1982

[54] LOUVER STRUCTURE

[76] Inventor: John V. Felter, P.O. Drawer 38271, Houston, Tex. 77088

[21] Appl. No.: 123,192

[22] Filed: Feb. 21, 1980

[51] Int. Cl.[3] ..... F24F 13/08

[52] U.S. Cl. ..... 98/121 R; 52/473

[58] Field of Search ..... 52/473, 74, 75, 76, 52/77, 78; 98/121 R, 88 L; 160/223

[56] References Cited

U.S. PATENT DOCUMENTS

| | | | |
|---|---|---|---|
| 1,677,910 | 7/1928 | Wills | 52/473 |
| 2,694,446 | 11/1954 | Smith | 52/473 |
| 2,758,534 | 8/1956 | Smith | 52/473 |
| 2,835,001 | 5/1958 | Matthews | 52/473 |
| 3,191,242 | 6/1965 | Rauen | 52/473 |

*Primary Examiner*—John E. Murtagh

*Attorney, Agent, or Firm*—Carl B. Fox, Jr.

[57] ABSTRACT

Louver structures having horizontally disposed overlapped members, whereby in one disposition, the louver structure sheds precipitation at one of its sides, and in reversed inverted disposition, the louver structure sheds precipitation at the other of its sides, in said one disposition the louver elements projecting from a wall in which the louver structure is installed, and in said reversed inverted disposition the louver elements being recessed into the wall in which the louver structure is installed.

1 Claim, 6 Drawing Figures

LOUVER STRUCTURE

BACKGROUND OF THE INVENTION

Louvers having various structures have been provided in the art. Without exception, the louvers of the art have been designed to be mounted in a single manner, with the vanes thereof being disposed in an outward and downward inclined disposition in a prespecified direction in order that the louver will properly shed precipitation and protect against the weather. No louver structure has been provided in the art which is adaptable for mounting in reversed dispositions, with the louver in each disposition being capable of sheding precipitation and protecting against the weather. The louvers of the art are of fixed dimensions, whereby for each louver size a separately designed louver must be provided. Examples of louver structures known in the art are shown in U.S. Pat. Nos. 2,862,439, 3,021,778, 3,248,837, 3,302,554, 3,580,160, 3,584,566, 3,645,195, 3,866,375, and 4,103,601, none of which shows a louver disposable for use in reversed directions, and none of which shows a louver structure formed by modular elements whereby its size may be varied. This invention seeks to provide a louver disposable in reversible dispositions, and constructed such that it may be of diverse sizes.

SUMMARY OF THE INVENTION

According to the invention, a louver structure is provided according to which the louver may be mounted for use in opposite dispositions, and may be made in diverse sizes simply by adding additional structural units to the assembly. The louver structure includes an upper part and a lower part between which are inconnected louver slat members in any desired number. Only one louver slat member may be used if desired. The overall size of the louver assembly depends on the number of louver slat members which are used. The uppermost louver slat member is connected to the upper member, and the lower most louver slat member is connected to the lower member, and additional louver slat members may be connected adjacently therebetween. The louver slat members are identical. The manner of connection of the louvers to the upper and lower members and to each other provides an overall rigid structure, the members being overlapped in a direction whereby the assembly is adapted to shed precipitation from one side in one disposition and to shed precipitation at the other side in an inverted reversed disposition. Both the upper and lower members and the louver slat members are adapted for manufacture from sheet metal in punch press operations, so that the cost of manufacture of the louvers is economical.

A principal object of the invention is to provide a louver structure which may be utilized in reversed dispositions. Another object of the invention is to provide a louver structure which is formed of assembled parts so that the louver structure may be made of different sizes. A further object of the invention is to provide such a louver structure which is capable of sheding precipitation in opposite or reversed dispositions. Yet another object of the invention is to provide louver structures which are dependable and economical.

Other objects and advantages of the invention will appear from the following detailed description of preferred embodiments, reference being made to the accompanying drawings.

BRIEF DESCRIPTIONS OF THE DRAWINGS

DESCRIPTION OF THE PREFERRED EMBODIMENTS

Figure 1:
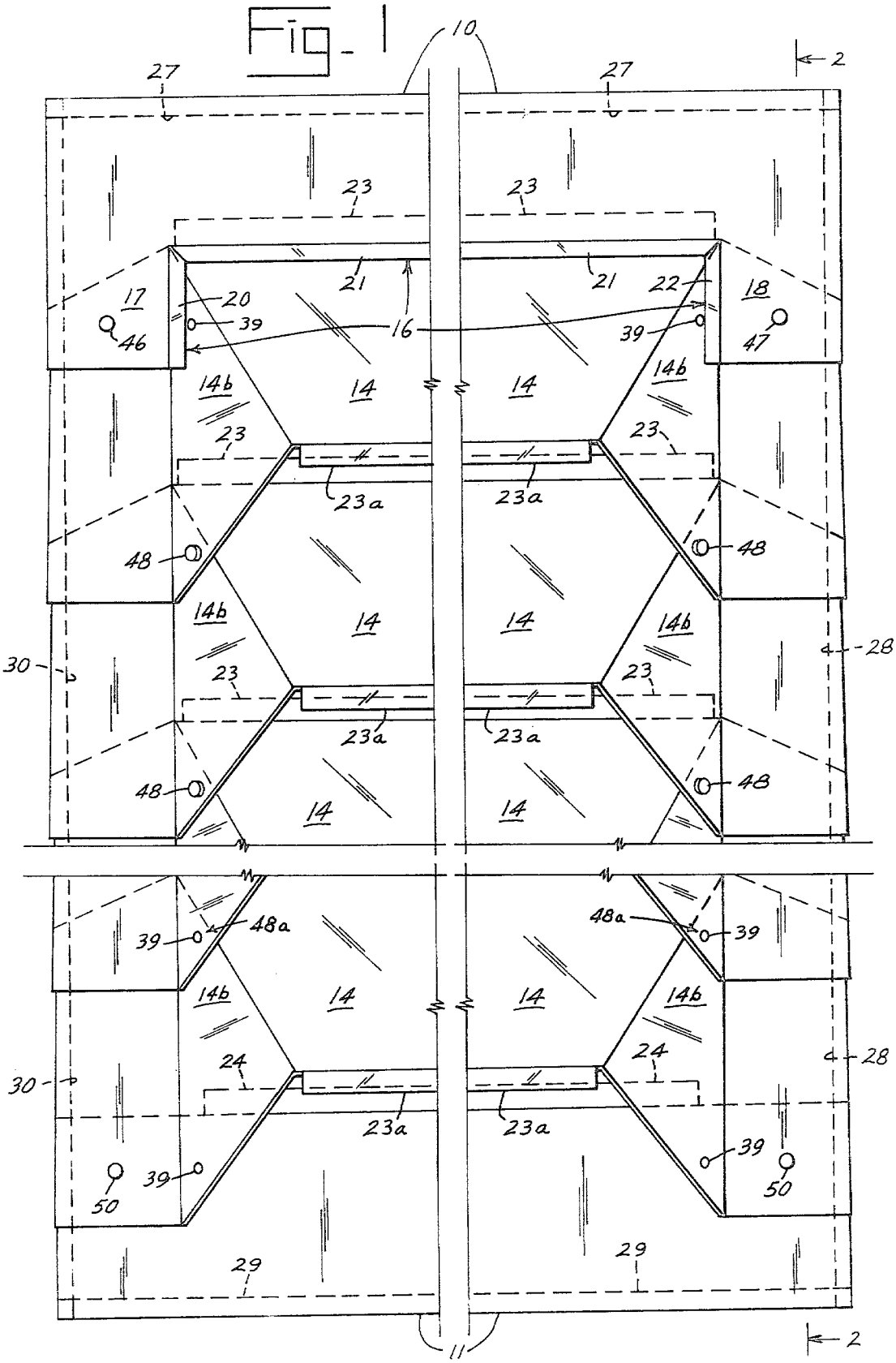
FIG. 1 is a front elevation of a preferred embodiment of apparatus according to the invention.

Referring now to the drawings in detail, the louver structure of preferred form according to the invention includes an upper member 10 disposed horizontally in a vertical plane and a lower member 11 also disposed horizontally in said vertical plane. A plurality of louver vane members 14 are disposed serially interconnected between the top member 10 and the bottom member 11.

The upper member 10 is preferably formed of sheet metal, as are all of the other members of the structure. The members may be formed of plastic material if desired. Member 10 is of rectangular form, having a cut out area 16 at its lower side. The cut out area 16 results in downwardly extending portions 17, 18. The edge portions 20, 21, 22 of cut out area 16 are upset angularly toward the viewer as the apparatus is shown in FIG. 1. Bottom member 11 is in the form of a flat sheet or plate and has an angularly formed tab portion 24 which is bent angularly toward the viewer as tha apparatus is shown in FIG. 1.

Figure 2:
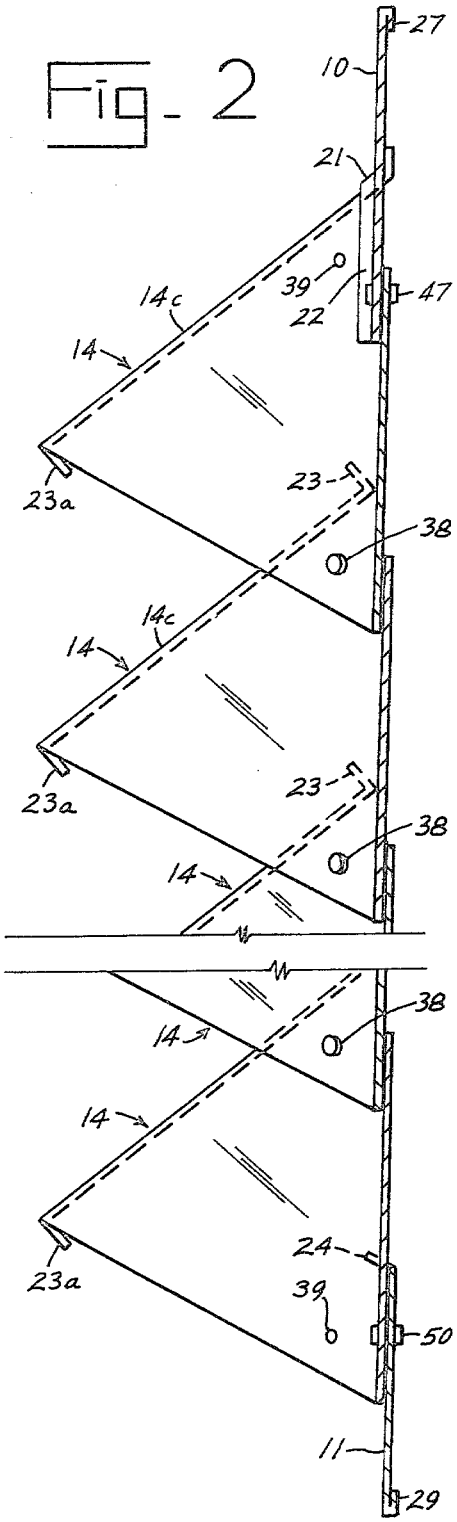
FIG. 2 is a vertical cross section taken at line 2—2 of FIG. 1.
Figure 3:
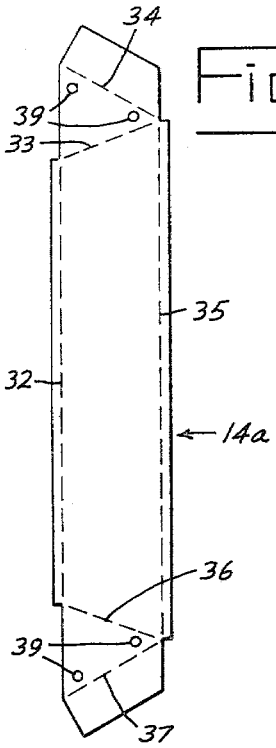
FIG. 3 is a plan view of a louver slat member in partially completed condition.
Figure 6:
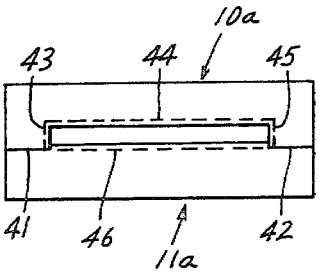
FIG. 6 is a plan view of end members of the louver structure in partially completed conditions.

After the apparatus elements have been assembled together, hems 27, 28, 29, 30 are formed at the respective sides of the apparatus, each hem consisting of a narrow folded over edge portion crimped tightly and flatly to eliminate sharp edges of the apparatus. The louver vane members 14 may be formed from flat sheets of metal by a punch press operation as is indicated in FIG. 3 of the drawings. Each member 14, before being bent along the dashed lines 32–37, has the flat form 14*a* shown in FIG. 3. To bring members 14 to the forms shown in FIGS. 1 and 2, the portion to the left of dashed line 32 is bent away from the viewer, the portion to the right of dashed line 35 is bent toward the viewer, the portion above dashed line 33 is bent angularly away from the viewer, the portion below dashed line 36 is bent angularly away from the viewer, and the portions above line 34 and below line 37 are bent toward the viewer to be parallel and in the same plane. Holes 39 may be punched in the same operation. Similarly, upper member 10 and lower member 11 may be formed by a punch press operation simultaneously from a single flat sheet of metal, as indicated in FIG. 6. Member 10 shown in the flat form 10*a*, and member 11 shown in the flat form 11*a*, are cut around their outer edges and are cut apart at lines 41, 42. Dashed lines 43–45 are the bend lines for formation of angularly upset flange portions 20–22 and dashed line 46 is the bend line for formation of tab 24.

Upper part 10 is first riveted to a louver vane member 14 at rivets 46, 47. Successive louver vane members 14 are each connected to an earlier assembled member 14 by rivets 48 disposed through overlapped angular portions 14*b*, as shown. From the side of the assembly toward the viewer in FIG. 1, and at the left in FIG. 2, each relatively upper part overlaps each relatively lower part. If the apparatus is viewed from the opposite side, then each relatively lower part overlaps each relatively upper part. The overlapped connections provide that the apparatus will shed water at its left side when the apparatus is in the position shown in FIG. 2, and from the opposite side when the apparatus is inverted. Bottom member 11 is connected to the lowermost of the louver vane members 14 by rivets 50. At 48*a*, the rivets 48 are not shown, but it will be understood that rivets 48 will be disposed through the holes 39 as is the case of the other connections. After the riveted assembly has been completed, the hems 27–30 are formed, which not only secure the edges of the overlapped members together but eliminate sharp edges around the assembly. The resulting structure is firmly interconnected and is strong and rigid. It will be realized that the sheetmetal thicknesses shown in the drawing figures are exaggerated, and that the overlaps form only minor offset cracks so that the surrounding edge portions of the apparatus are substantially flat.

Figure 4:
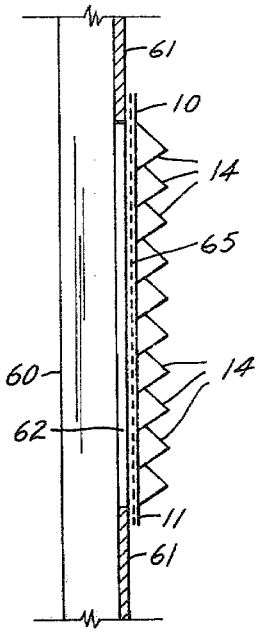
FIGS. 4 and 5 are illustrative views indicating the manner of installation and use of the louvers in reversed dispositions.

Referring now to FIG. 4 of the drawings, which is schematic, element 60 is a wall supporting stud or other structural member. Element 61 is any form of wall board or sheathing used to complete a wall. An opening 62 of a size to accommodate a louver assembly according to the invention is provided through wall member 61, a member 60 preferably being disposed along each vertical side of opening 62. The louver having louver vane members 14 and upper member 10 and lower member 11 is connected to wall 61 around opening 62 by suitable fasteners such as nails or screws, not shown. Holes for the fasteners through the surrounding flange-like part of the apparatus may be provided, although these are not shown in the drawings. In the installation shown in FIG. 4, the left side of the apparatus of FIG. 2 is toward the right so that the louver vane members 14 protrude outwardly from wall 61. The manner of overlapping of members 10, 11 and louver vane members 14 therebetween is such that water will be shed from the apparatus at the righthand side thereof. Dashed line 65 indicates a sheet of screening material inserted between the louver and wall 61 to prevent entry of insects into the building.

Figure 5:
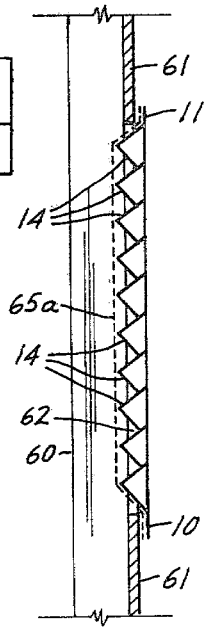

Referring now to FIG. 5 of the drawings, a louver assembly is shown installed at an opening 62 in wall 61 in reversed inverted position as regards the position of the louver in FIG. 4. The louver vane members 14 protrude toward the left in FIG. 5, through the opening 62. Since the louver apparatus is inverted in FIG. 5, the apparatus will completely shed water or other precipitation falling thereagainst from the righthand side of wall 61. By inverting FIG. 2, it can be seen how the overlapping of the members 10, 11 and 14 will shed precipitation in the described manner when the apparatus is inverted. Dashed line 65*a* indicates how a sheet of screening material may be disposed between the outer flange-like portions of the ventilator and wall 61 in order to prevent ingress of insects into the building.

Comparing FIGS. 4 and 5, it is readily seen that the apparatus may be installed to protrude from wall 61 or to be recessed into wall 61. The angular edge portions 20–22, 23, 23*a* and 24 serve to prevent ingress of moisture past the louver installed in either direction. Referring to FIG. 2 of the drawings, water blown against a surface 14*c* of a louver vane member 14 will be prevented from being blown inwardly of the angularly upper end of the vane by the flange 23 when the apparatus is installed as in FIGS. 2 and 4. When the apparatus is inverted and installed as shown in FIG. 5, flange 23*a* will prevent inblown water from passing the vane at the upper edge of the vane.

The offset positions of rivets 38 with regard to the hems 28, 30 provide leverage which improves the strength and rigidity of the apparatus, as compared with a structure in which the overlapped edge portions are riveted together in line with rivets 46, 50, at one side, and in line with rivets 47, 50, at the other side. Nonetheless, the rivets may be disposed at the overlapped edge portions if desired.

For storage and transport, a plurality of louvers may be nested together, with the protruding portions of the members 14 of each disposed one within the other. in this manner, the bulk volume of the plurality of louvers may be reduced during storage and transport, and with mutual protection of the plurality of louvers against damage resulting.

The manufacture of the apparatus is very simple and economical. With the members 10, 11, and 14 preformed by punch press operations, which are very inexpensive, the apparatus assembly may be done very rapidly by simple riveting and heming operations. As has been stated earlier, the louvers may be varied in size by varying the number of louver vane members 14 in the assembly. Of course, the horizontal lengths of the members may be as desired.

While preferred embodiments of the apparatus have been described and shown in the drawings, many modifications thereof may be made by a person skilled in the art without departing from the spirit of the invention, and it is intended to protect by Letters Patent all forms of the invention falling within the scope of the following claims.

I claim:

1. Louver apparatus, comprising a first end member, a second end member disposed parallely spaced from said first end member, and at least one vane member disposed parallely between said first and second end members to provide air passage means past said apparatus, said first end member and said vane members and said second end member being serially connected one to another to form a composite structure in which each said vane member bridges between adjacent others of said members, said first and second end members being of elongate substantially flat form and each said vane member having substantially flat portions at its opposite ends and having an angularly upset portion between said opposite end portions, said members being disposed parallely one above another in horizontal dispositions with said end members and said end portions being disposed along a vertical plane, said members being successively overlapped with each member overlapping adjacent members at the same sides thereof, whereby said apparatus is adapted to shed precipitation at its opposite sides in relatively inverted positions, each said vane member having an angular inwardly converging portion between each said end portion and said angularly upset portion, said vane members being riveted together at said angular inwardly converging portions.

* * * * *